US007909201B2

(12) United States Patent
Chornenky

(10) Patent No.: US 7,909,201 B2
(45) Date of Patent: Mar. 22, 2011

(54) PAINT CAN WITH POUREDGE

(76) Inventor: Daniel Chornenky, Elizabeth, PA (US)

( * ) Notice: Subject to any disclaimer, the term of this patent is extended or adjusted under 35 U.S.C. 154(b) by 400 days.

(21) Appl. No.: 12/150,428

(22) Filed: Apr. 28, 2008

(65) Prior Publication Data

US 2008/0272133 A1 Nov. 6, 2008

Related U.S. Application Data

(63) Continuation-in-part of application No. 11/020,941, filed on Dec. 22, 2004, now abandoned.

(51) Int. Cl.
*B65D 25/00* (2006.01)
*B65D 90/02* (2006.01)

(52) U.S. Cl. ..... 220/699; 220/669

(58) Field of Classification Search ..... 220/699, 220/700, 701, 702, 694, 697, 696, 695, 787, 220/783, 801, 675, 796, 669, 784, 780, 623, 220/610, 571.1, 570, 672, 670, 733, 698, 220/DIG. 5, 659, 657, 656, 660; 222/572; D9/776, 773, 772, 763, 906
See application file for complete search history.

(56) References Cited

U.S. PATENT DOCUMENTS 1,696,240 A * 12/1928 Kircher, Jr. ..... 220/797
2,720,346 A * 10/1955 Compton ..... 222/570
2,837,256 A * 6/1958 Daner ..... 222/568
5,269,438 A * 12/1993 Kelsey ..... 220/766
5,341,969 A * 8/1994 Accardo et al. ..... 222/465.1
5,549,216 A * 8/1996 Scholl ..... 220/695
5,568,879 A * 10/1996 Kovathana ..... 220/697
5,810,196 A * 9/1998 Lundy ..... 220/736
5,924,593 A * 7/1999 Rutledge et al. ..... 220/695
6,175,987 B1 * 1/2001 Harvey ..... 15/257.01
2001/0025865 A1 * 10/2001 Bravo et al. ..... 222/465.1
2002/0070223 A1 * 6/2002 Elvin-Jensen et al. ..... 220/669
2003/0102340 A1 * 6/2003 Walsh et al. ..... 222/572

* cited by examiner

*Primary Examiner* — Anthony Stashick
*Assistant Examiner* — Robert J Hicks
(74) *Attorney, Agent, or Firm* — James Ray & Assoc

(57) ABSTRACT

An apparatus disposed in a paint can for at least one of removing excess paint from a brush, pouring paint from a can without paint being trapped in a recessed portion of such can which receives a lid. The apparatus comprises a container member having a predetermined shape and size. A specially configured pouring edge is formed integral with the container member. There is a curved portion that is formed from a rim portion of the container member or formed and molded on such inner surface of the side wall of the container member closely adjacent the pouring edge. Such curved portion extends inwardly from the inner surface of the side wall and includes a concave portion formed on it. There is a lid member for sealing the container member, a portion of the lid member engages the concave portion for forming a seal.

11 Claims, 2 Drawing Sheets

PAINT CAN WITH POUREDGE

CROSS REFERENCE TO RELATED APPLICATION

This application is a Continuation-in-Part application and claims priority benefits of patent application Ser. No. 11/020,941 filed Dec. 22, 2004 now abandoned. The teachings of this related application are incorporated herein by reference thereto.

FIELD OF THE INVENTION

The present invention relates, in general, to an aid for painting and, more, particularly, the present invention relates to a paint container that a non drip pour edge built into the container and a modification which provides a seal for the lid at such pour edge.

BACKGROUND OF THE INVENTION

Painters and do-it-yourself home owners that do home painting themselves always have a problem when pouring paint from one container to another. Paint cans have been used for years without any modification to the can. Invariably paint cans have a rim around the circumference of the can wherein a lid is inserted to seal the can and prevent spillage. However, there is a problem that exists with the present can in that when paint is poured out of the can paint always ends up in the rim and when the lid is reapplied to the can great care must be taken to prevent paint from spattering when the lid is forced into the rim. Also when one is pouring from the can with a rim, care must be taken to prevent spillage. One other problem encountered with cans having a normal rim is that when the brush is wiped remove excess paint, some paint generally gets into the rim and it becomes difficult to keep the brush clean.

Thus, it would be advantageous if there were a paint can that had a pour edge so as to eliminate or at least keep any spilling to a minimum.

SUMMARY OF THE INVENTION

In a first aspect the present invention provides an apparatus formed in a paint container for at least one of removing excess paint from a brush and for pouring paint from such paint container without paint being trapped in a recessed portion of such paint container which receives a lid, such apparatus comprises a container member having a predetermined size and shape. A specially configured pouring edge is formed integral with the container member, the specially configured pouring edge having a first predetermined length along a periphery of the container member and a first predetermined width extending inwardly from an inner surface of a side wall of said container member. There is a curved portion that is at least one of formed from a rim portion of the container member and one of formed and molded on such inner surface of the side wall of the container member closely adjacent the specially configured pouring edge. Such curved portion extends inwardly from the inner surface of the side wall and includes a concave portion formed thereon. Such curved portion has a second predetermined length along the periphery of the container member and a second predetermined width extending inwardly from the inner surface of the side wall of the container member. There is a lid member for sealing the container member, a portion of the lid member engages the concave portion of the curved portion for forming a seal thereon.

OBJECTS OF THE INVENTION

It is, therefore, one of the primary objects of the present invention to provide a paint can wherein a portion of the rim is modified so as to provide a pouring means.

Another object of the present invention is to provide a means formed of molded on the side of the can for sealing against the lid of the container.

Still another object of the present invention is to provide a means wherein the pour edge can be used for removing excess paint from the brush without leaving excess paint in the rim.

Yet another object of the invention is to provide a modified can which is inexpensive to manufacture.

Another object of the invention is to provide a modified container with a pour edge that can be made with either metal or plastic.

In addition to the numerous objects and advantages of the present invention which have been described with some degree of particularity above, it should be both noted and understood that a number of other important objects and advantages of the invention will become more readily apparent to those persons who are skilled in the relevant art of painting from the following more detailed description of the invention, particularly, when such detailed description is taken in conjunction with the appended claims.

Figure 2:
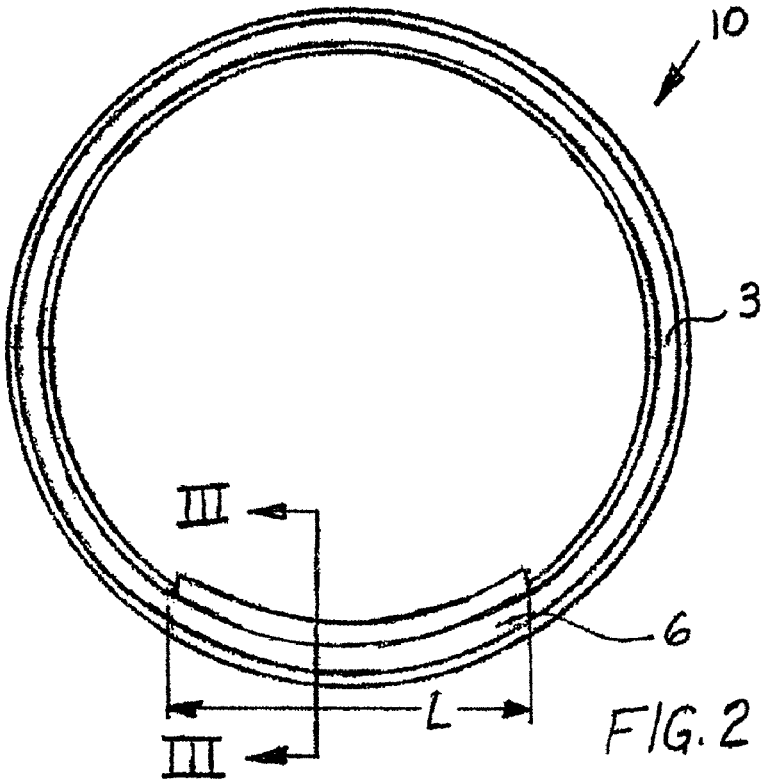
FIG. 2 is a top view of the paint container showing the pour edge.
Figure 1:
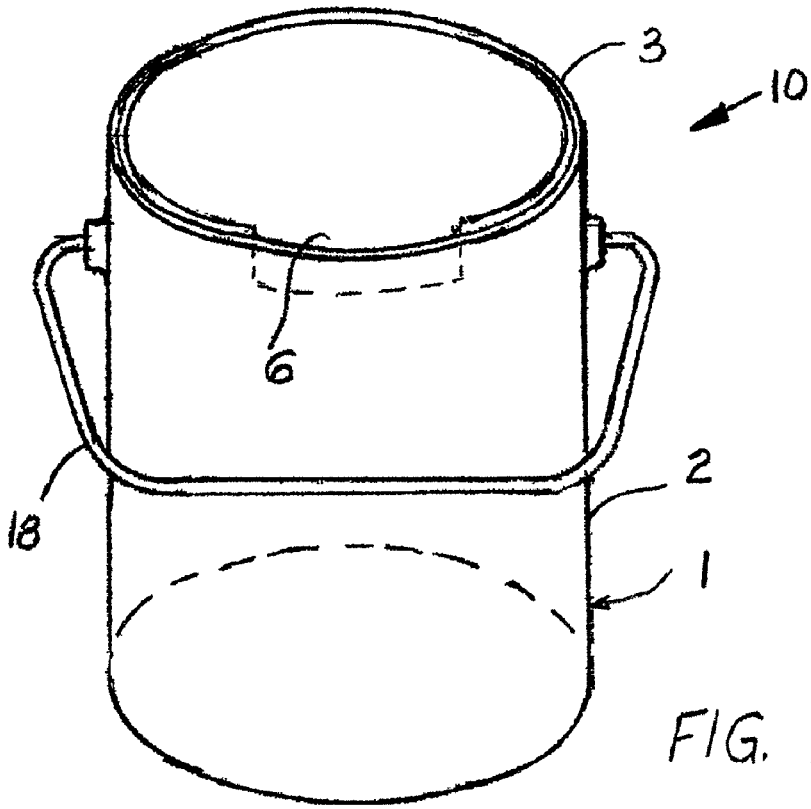
FIG. 1 is a perspective view of a paint container according to an embodiment of the invention.
Figure 4:
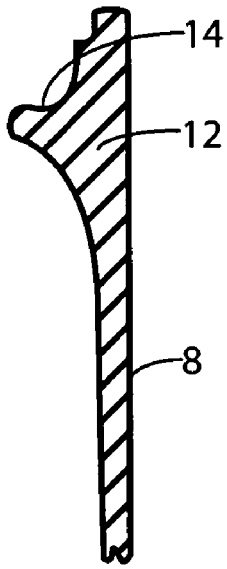
FIG. 4 is a side view of the curved portion according to an embodiment of the invention.
Figure 3:
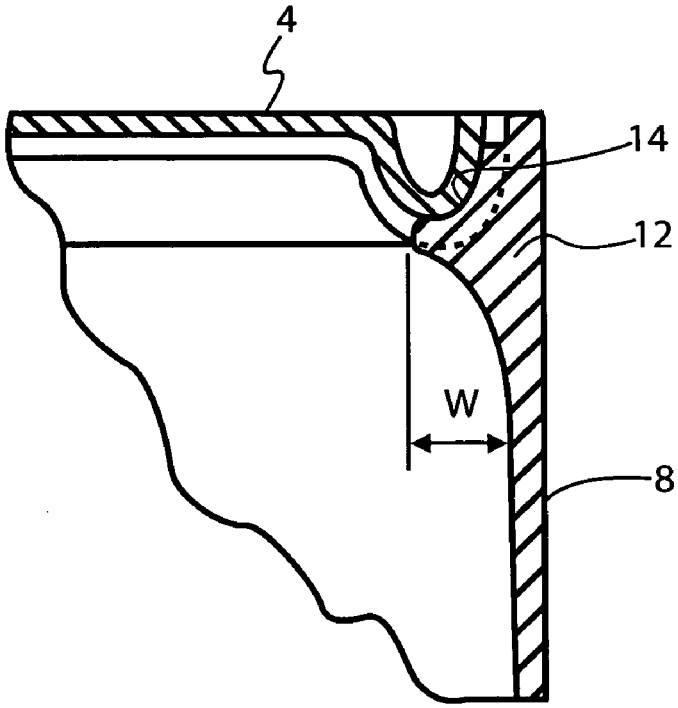
FIG. 3 is a cross sectional view of the container shown in FIG. 2 taken across the lines of III-III with a lid member attached thereto showing the seal formed by the lid member against the curved portion.

BRIEF DESCRIPTION OF THE PRESENTLY PREFERRED AND VARIOUS ALTERNATE EMBODIMENTS OF THE PRESENT INVENTION

Prior to proceeding to the more detailed description of the present invention, it should be noted that for the sake of clarity in understanding the invention, identical components with identical functions have been designated with identical reference numerals throughout the drawing Figures.

In a first aspect the present invention provides an apparatus, generally designated 10, formed in a paint container 1 for at least one of removing excess paint from a brush and for pouring paint from such paint container 1 without paint being trapped in a rim 3 (recessed portion) of such paint container 1 which receives a lid, such apparatus 10 comprises a container member 2 having a predetermined size and shape. A specially configured pouring edge 6 is formed integral with the container member 2, the specially configured pouring edge 6 has a first predetermined length L along a periphery of the container member 2 and a first predetermined width W extending inwardly from an inner surface of a side wall 8 of the container member 2. There is a curved portion 12 that is at least one of formed from a rim portion of the container member 2 and one of formed and molded on such inner surface of the side wall 8 of the container member 2 closely adjacent the specially configured pouring edge 6. Such curved portion 12 extends inwardly from the inner surface of the side wall 8 and includes a concave portion 14 formed thereon. Such curved portion has a second predetermined length along the periphery of the container member 2 and a second predetermined width extending inwardly from the inner surface of the side wall 8 of the container member 2. There is a lid member 4 for sealing the container member 2, a portion of the lid member 4 engages the concave portion 14 of the curved portion 12 for forming a seal thereon.

As described the rim portion 3 of the container 1 is modified to provide a pour edge 6 for easier pouring wherein paint does not get into the rim portion 3 of the container 1. The modification includes a curved portion 12 on an inner side wall 8 of the container member 2. The curved portion 12 has a concave portion 14 formed thereon for sealing against a portion of the lid member 4 when the container 1 is being closed.

When the lid 4 is removed this pour edge 6 (the portion of the rim of the can that is modified) permits an area for pouring the paint from the container member 2 to another container. Since the paint is poured over the part of the container 1 with a modified rim the problem with getting paint into the rim 3 is eliminated. Such pour edge has a first predetermined length L that is substantially between about 4 inches and about 5 inches around the periphery of the container 2. (Approximately 4½ inches). The rim portion is modified so as to be substantially folded over against the sidewall 8 of the container member 2 or formed or molded so as to form the pour edge 6 and the concave portion 14 of the curved portion 12 disposed on the side wall 8 is for sealing against the lid 4. The lid member 4 fits into the rim 3 of the container member 2 except for that portion with a modified rim. The lid 4 forms a seal against the concave portion 14 of the curved portion 12 so as to keep a substantially airtight seal with the container member 2.

The pour edge 6 is also used to remove excess paint from the brush before painting. Since all excess paint merely drains back into the container 1 there is no mess with paint getting in the rim 3 of the container 1. Further, the painter does not have to pour paint over the rim 3 as is presently done but pours from the area where the rim 3 is modified. This makes pouring much easier with less paint spillage and also having less paint spilled on the outside of the container 1 and in the rim 3 of the container 1.

It should be noted that such pour edge 6 can be used on metal or plastic containers. Such pour edge 6 is also applicable to be used with either quart or gallon containers. Such container member 2 further includes a handle member 18.

As stated previously such first predetermined length is between about 4 inches and about 5 inches around the periphery of the container member 2. It is also preferred that such second predetermined length is substantially identical to the first predetermined length. It is also preferred that such first predetermined width and such second predetermined width are substantially identical.

Again, as stated previously such container member 2 can be formed of either metal or plastic. In the case where the container member 2 is formed of plastic it is preferred that such plastic be blow molded. Also it is preferred that such predetermined shape of such container member 2 is generally round.

While a presently preferred embodiment and alternate embodiments of the present invention have been described in detail above, it should be understood that various other adaptations and/or modifications of the invention can be made by those persons who are particularly skilled in the art without departing from either the spirit of the invention or the scope of the appended claims.

I claim:

1. An apparatus formed in a paint container for at least one of removing excess paint from a brush and for pouring paint from such paint container without paint being trapped in a recessed portion of such paint container which receives a lid, said apparatus comprising:

(a) a container member having a predetermined size and shape;

(b) a specially configured pouring edge formed integral with said container member, said specially configured pouring edge having a first predetermined length along an inner periphery of said container member and a first predetermined width extending inwardly from an inner surface of a side wall of said container member;

(c) a curved portion at least one of formed from a rim portion of said container member and one of formed and molded on said inner surface of said side wall of said container member closely adjacent said specially configured pouring edge, said curved portion extending inwardly from said inner surface of said sidewall and including a concave portion formed on said curved portion, said curved portion having a second predetermined length along said periphery of said container member and a second predetermined width extending inwardly from said inner surface of said side wall of said container member; and (d) a lid member for sealing said container member, a portion of said lid member for engagement with said concave portion of said curved portion for forming a seal thereon.

2. The apparatus, according to claim 1, wherein said container member is one of plastic and metallic.

3. The apparatus, according to claim 2, wherein said container member is metallic.

4. The apparatus, according to claim 1, wherein said container member further includes a handle.

5. The apparatus, according to claim 1, wherein said first predetermined length is between about 4 inches and about 5 inches.

6. The apparatus, according to claim 5, wherein said second predetermined length is substantially identical to said first predetermined length.

7. The apparatus, according to claim 1, wherein said first predetermined width and said second predetermined width are substantially identical.

8. The apparatus, according to claim 2, wherein said container member is plastic.

9. The apparatus, according to claim 8, wherein said plastic container member is blow molded.

10. The apparatus, according to claim 1, wherein said predetermined shape of said container member is generally round.

11. The apparatus, according to claim 7, wherein said predetermined size of said container member is one of a quart and a gallon.

* * * * *